US005947024A

United States Patent [19]

Birkenfeld

[11] Patent Number: 5,947,024

[45] Date of Patent: Sep. 7, 1999

[54] DEVICE TO PREVENT DAMAGE TO PRINTING GROUPS

[75] Inventor: Andreas Birkenfeld, Dinkelscherben, Germany

[73] Assignee: Baldwin Grafotec GmbH, Augsburg, Germany

[21] Appl. No.: 09/127,912

[22] Filed: Aug. 3, 1998

[30] Foreign Application Priority Data

Aug. 7, 1997 [DE] Germany ..... 197 34 137

[51] Int. Cl.[6] ..... B41F 5/04

[52] U.S. Cl. ..... 101/219; 101/226

[58] Field of Search ..... 250/341, 572; 340/259; 26/1; 73/597, 628; 101/226, 219

[56] References Cited

U.S. PATENT DOCUMENTS

| | | | |
|---|---|---|---|
| 3,906,232 | 9/1975 | Meihofer | 250/341 |
| 3,928,844 | 12/1975 | Meihofer | 340/259 |
| 4,335,316 | 6/1982 | Glanz et al. | 250/572 |
| 5,036,706 | 8/1991 | Gnuechtel et al. | 73/597 |
| 5,130,557 | 7/1992 | Kettl | 250/561 |
| 5,190,201 | 3/1993 | Briggs | 26/1 |
| 5,289,007 | 2/1994 | Hergert | 250/341 |
| 5,652,388 | 7/1997 | Callan et al. | 73/628 |
| 5,678,484 | 10/1997 | Callan et al. | 101/226 |

*Primary Examiner*—Edgar Burr
*Assistant Examiner*—Charles H. Nolan, Jr.
*Attorney, Agent, or Firm*—Jones, Tullar & Cooper, P.C.

[57] ABSTRACT

The present invention relates to a device to prevent damage to printing groups of web-fed rotary presses that print webs fed by a cylinder which is placed on a reel changer. A fault detector is provided that has a deflection device next to both web edges. It can create a deflective force transverse to the web plane transport, which can be overcome by the tension of the web during normal operation. A monitor is also provided that detects changes. With the aid of this device, damage to printing groups can be prevented (especially arising from defects occurring during reel exchange) by locating the fault detection device in front of the first printing group of the web-fed rotary press, and each of the two monitors of the fault detector is designed as an optical sensor that emits a signal which depends on shading by the web, and its optical axis is tilted in the lengthwise direction of the web in relation to the direction of the deflection force that is essentially perpendicular to the transport plane of the web.

14 Claims, 2 Drawing Sheets

FIG. 2
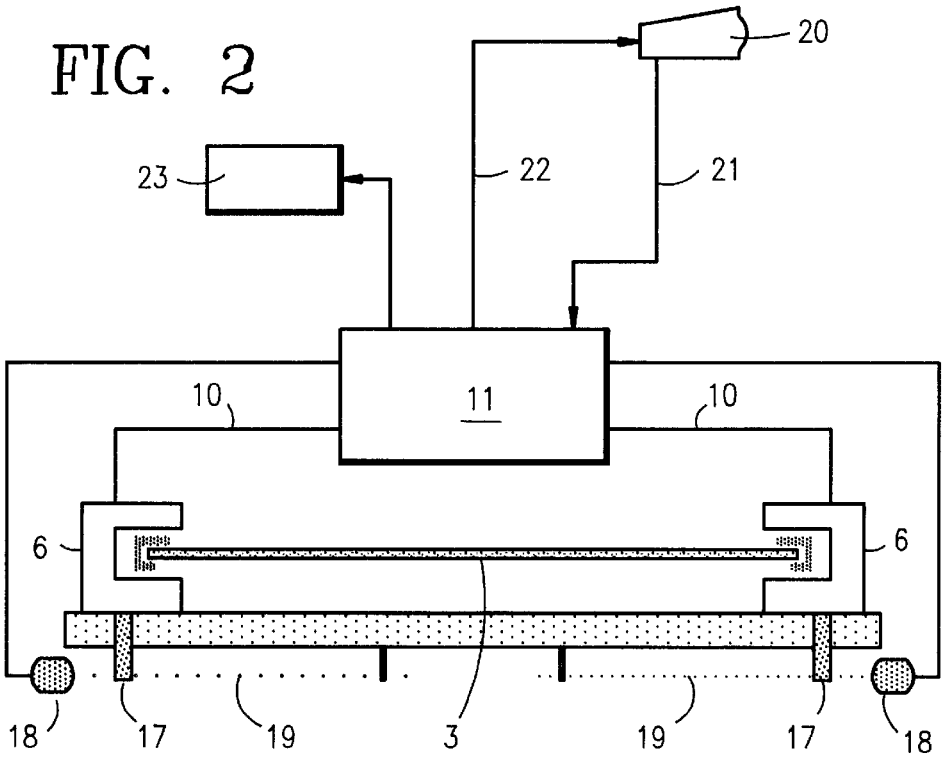
FIG. 1
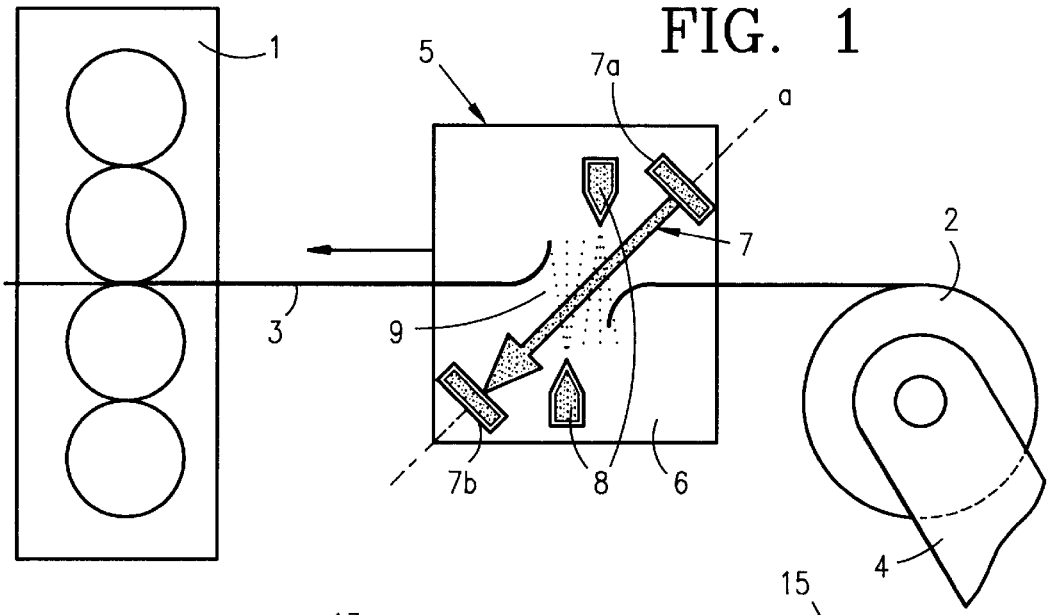
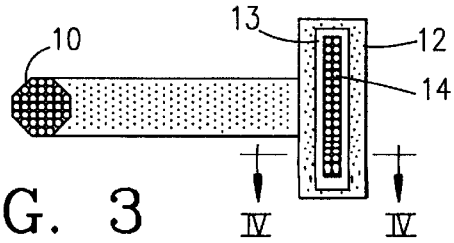
FIG. 3
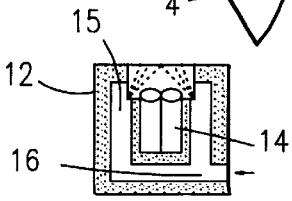
FIG. 4

DEVICE TO PREVENT DAMAGE TO PRINTING GROUPS

BACKGROUND OF THE INVENTION

1. Field of the Invention

The present invention relates a device to prevent damage to printing groups of web-fed rotary presses that print webs fed by a cylinder which is placed on a reel changer. A fault detector is provided that has deflection devices next to both web edges that can create a deflective force transverse to the plane of web transport that can be overcome by the tension of the web during normal operation, and a monitor is provided that detects changes.

2. Background Art

There is a prior-art device of this kind disclosed in EP 429 970 B1. This prior art arrangement relates to a web-break detector which follows the printing group and triggers a web catching device between the last printing group and the drier. This prior art device is based on the fact that the web tension is released when the web tears; this causes the web to be displaced which is detected by the monitors. The monitors are designed as light barriers whose optical axis is angled in the direction of the width of the web and is interrupted at the edge of the web during normal operation. A light barrier only registers "yes" or "no." This is sufficient for a web-break switch following the printing groups. Experience has shown, however, that the web entering the printing groups can have lateral defects arising especially from faulty gluing at the connection between the old and new web and/or transport damage which can produce strips wound on one side of a printing group roller. To deal with this, it would be insufficient to place the prior art arrangement in front of the printing groups. The size of the defect passing through the system cannot be determined with the prior-art arrangement. It would hence also be impossible to permit a certain tolerance width. This would in certain circumstances lead to incorrect reactions. It would also be impossible with the prior-art arrangement to evaluate the type of fault passing through the system from the signals generated by the monitors so that an adequate reaction often cannot occur. A further disadvantage is that due to the arrangement of the light barriers, improper adhesion between overlapping web ends during reel exchange cannot be recognized. The prior-art arrangement would therefore not be suitable to prevent damage to printing groups arising from adhesion faults, etc.

SUMMARY OF THE INVENTION

An object of the present invention is to provide a device of the initially-cited kind by easy and economical means to reliably prevent print group damage arising from faults from changing reels and/or damage to the web edges from transport, etc.

This object is achieved according to the present invention by locating the fault detection device before the first printing group, and each of the two monitors of the fault detector is designed as an optical sensor that emits a signal depending on the interruption by the web, and its optical axis is tilted in the lengthwise direction of the web in relation to the direction of the deflection force that is essentially perpendicular in relation to the transport plane of the web.

These measures fully eliminate the above-described problems. Due to the specific design and arrangement of the sensors, the device according to the present invention advantageously recognizes both a lateral web displacement arising when changing reels, and lateral defects such as incomplete adhesion of the overlapping web ends or enclosed, small tears. Since the optical axis of the sensors is tilted in the lengthwise direction of the web, the sensors can advantageously look through the gap between overlapping web ends opened by the assigned deflection device. Since the optical sensors generate a signal related to the degree of interruption (i.e., a value-related signal), a tolerance range can be advantageously set within which fluctuations are tolerated. In addition, this advantageously allows the kind of errors to be recognized which is a prerequisite for pursuing suitable help.

Advantageous embodiments and useful developments of the generic measures will become apparent from the discussion that follows. For example, the fault detector is located near the reel changer, approximately at its outlet. This ensures that even at high web speeds there is enough time to transmit corresponding actuating signals to the printing machine in case of an error and implement the corresponding operations, e.g., "stop printing."

Another advantageous measure is for the deflection device to have at least two deflection units preferably designed as air nozzles that are mutually offset (viewed from the lengthwise direction of the web) and are on different sides of the web. This ensures that the overlapping web ends can be reliably lifted from each other when there is insufficient adhesion.

The monitor can preferably be designed as a fiberoptic sensor that is connected to the control device via a fiber bundle. Fiberoptic sensors are cheap, robust and advantageously temperature-independent elements that are available in different widths so that the recognition range can be easily adapted to individual cases. Since light can be guided to and from a controller over a large distance, electrical or electronic devices do not have to be located directly next to the web so that disturbances arising from static discharge need not be feared.

The monitor can advantageously be located in a chamber which can receive compressed air and that has an exit slot facing the web. This advantageously rinses the optical elements with air and prevents them from becoming soiled which has an advantageous effect on the reliability and servicing.

The monitors with the associated deflector can be in laterally-adjustable, preferably motor-driven slides controlled by the control device. This advantageously allows the elements of the fault detector to be automatically adjustable and guarantees easy operation.

Further advantageous embodiments and useful developments of the generic measures can be found in the following exemplary description with reference to the drawing.

BRIEF DESCRIPTION OF THE DRAWINGS

FIG. 1 is a schematic view of a web-fed rotary press with a device according to the present invention, FIG. 2 is a schematic view of the device according to the present invention with a cross-section of a web, FIG. 3 is a top view of a fiber-optic sensor of the device according to the present invention, FIG. 4 is a section along line IV/IV in FIG. 3.

DETAILED DESCRIPTION OF THE PREFERRED EMBODIMENTS

Figure 5:
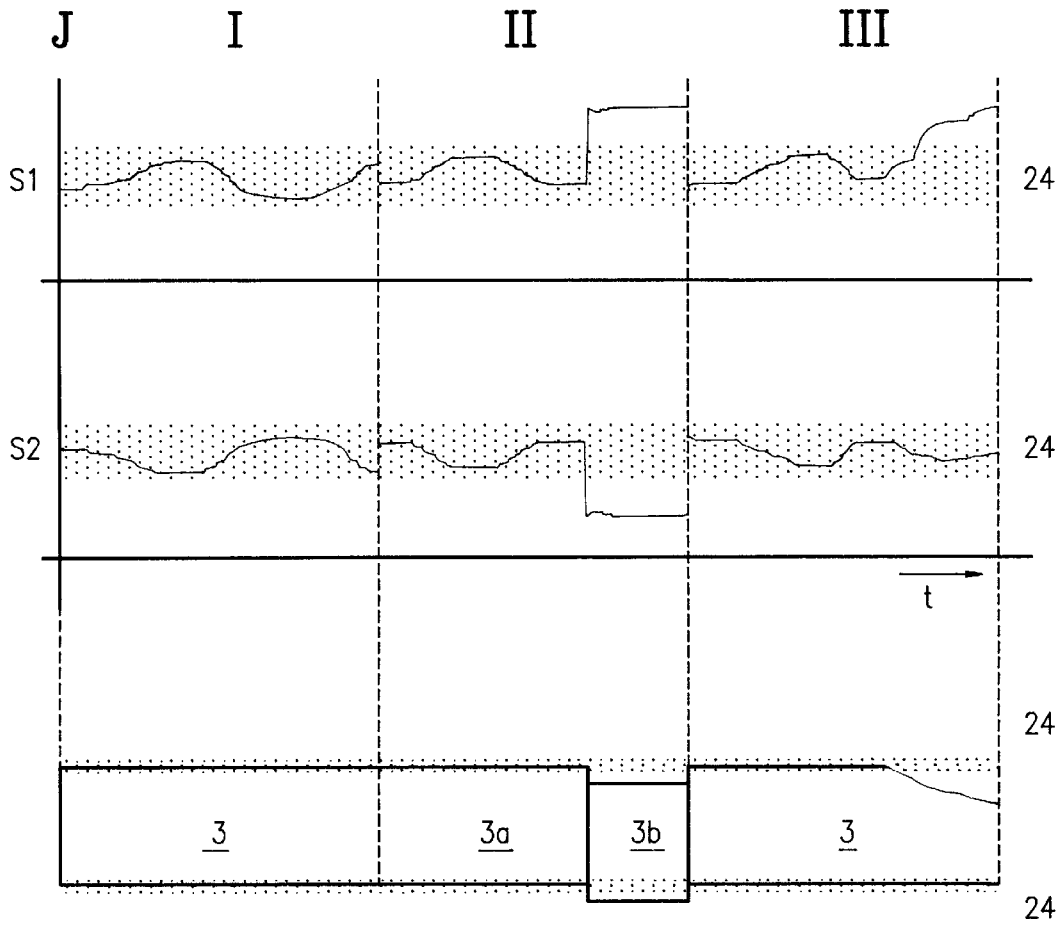
FIG. 5 is an overview of the sequence of sensor signals in three different instances.

The design and operation of web-fed rotary printers and the reel changers in front of them are known per se and therefore do not require any further explanation in the present context. FIG. 1 shows a first printing group 1 of a web-fed rotary press that is fed by a web 3 wound off a cylinder 2. The cylinder 2 is on a reel changer 4 that allows automatic reel exchange.

When reels are exchanged, the web ends to be joined can be glued together laterally offset as shown in FIG. 5, column II at the bottom, or the adhesion is not complete at the web edges as shown in FIG. 5, column III at the bottom. Errors of this kind and other lateral defects such as tears produce a lateral sag without tension. This can adhere to the cylinder of the printing group 1 that prints the web 3 due to the adhesive effect of the printing ink and produce a wound strip on the side. This problem is enhanced due to the collection of ink at the edge of a printed image.

To avoid wound strips of the above-cited kind and the related damage to printing groups, a fault detector 5 through which the web 3 passes is located in front of the first printing group 1. This is as close as possible to the reel changer 4 (approximately at the outlet of the reel changer 4) to allow as much time as possible between the point when a web defect passes through the fault detector and the point when it enters the first printing group 1 to allow suitable measures to be taken. When a defect of the web 3 is detected, the cylinders of all printing groups of the web-fed rotary press are put in a "stop printing" position so that the faulty site in the web 3 passes through without contacting the cylinders. If a waste paper shunt is located near the folder (usually following the web-fed rotary press), it is opened to remove the web area with the defect. When the web-fed rotary press is set up for continuous washing where the washing liquid and ink removed by the liquid are drained off, the washing process is hindered when a defect passes through. When a web-catching device is provided (that is usually located between the last printing group and the following dryer) and if the web-break detector provided to activate the catching device is designed to be activated when a web defect of the above-cited kind passes by, the activation of the catching device is also suppressed.

The fault detection device 5, as can be seen in FIG. 2, comprises detection units 6 near both web edges, and the units contain a monitor 7 and a deflection unit 8 assigned to the monitor as shown in FIG. 2. The deflector unit 8 in the portrayed embodiment consists of two deflection units that are above and below the web 3 and offset in the lengthwise direction of the web. These are designed as air nozzles for compressed air that allow contactless displacement of a web section that is without tension. The use of suction nozzles is also conceivable. The axis of the air nozzles forming the deflecting device 8 is perpendicular to the plane of transport of the web 3. By offsetting the nozzles in a lengthwise direction, the overlapping web ends that are not mutually connected are reliably lifted from each other as shown in FIG. 1. This produces a gap 9 through which the monitor 7 can look.

The monitor 7 is designed as an optical sensor that consists of two elements respectively above and below the web 3 in the form of a transmitter 7*a* and receiver 7*b*. The optical axis "a" of the optical sensor forming the monitor 7 is tilted (at least in the lengthwise direction of the web) in relation to the deflection force (that is essentially perpendicular to the web plane) created by the deflection device 8 as illustrated in FIG. 1. A tilt angle of 60° has proven to be suitable in experiments. In addition, the optical axis can be tilted with reference to the width of the web. To the extent that the beginning of the new web is glued to the old web from below while changing reels, the top of the optical axis "a" is tipped back against the direction of transport of the web and visa versa. Tipping the sensor forming the monitor 7 in the lengthwise direction of the web 3 ensures that the optical axis "a" can penetrated through a gap 9 between the overlapping web ends opened by the deflection device 8 as illustrated in FIG. 1. If the optical axis "a" were in a plane perpendicular to the web plane, the gap 9 would not be penetrated in certain circumstances because it would be covered.

The optical sensors provided to form the monitor 7 are usefully designed as fiberoptic sensors whose transmitters and receivers are on the end of a light guide 10 formed by a fiber bundle as can be seen in FIG. 3. The elements of the monitor 7 are connected to a control device 11 via their light guides 10 as shown in FIG. 2, and the controller contains the required electrical and electronic devices to generate the transmitted light and process the received light. The controller 11 which has a computer to process the arriving signals is sufficiently distant from the web 3 so that electrostatic discharges will not disturb the electrical and electronic units. The fiber bundle forming the light guide 10, as shown in FIG. 3, extends into a housing 12 that has a slot 13 facing the web 3 which serves as a light inlet/outlet slot. The housing-side ends of the light guide fibers are arranged in the form of a row 14 (consisting of one or more lines) assigned to the slot 13 so that light can be transmitted or received though the slot 13.

As can be seen in FIG. 4, the chamber 15 delimited by the housing 12 is provided with a compressed air connection 16. The air exits via slot 13 and serves as cleaning air as it passes by the ends of the light guide fibers forming the row 14 and keeps them clean. This ensures reliable and service-free operation.

The rows of fibers 14 of the transmitters and receivers of the sensors are exactly aligned with each other. As can be seen in FIG. 2, the receiver is partially covered by the web 3 and therefore only receives some of the light emitted by the transmitter. The more the web 3 is covered, the less light passes through. Processing the amount of received light correspondingly produces a signal corresponding to the shading by the web. The detection unit 6 is basically set so that 50% of the light is shaded at the two web edges.

To make it easier to laterally adjust the monitor 7 and detectors 6 containing the associated deflection device 8, the detectors are in associated slides 17 that can move laterally. The slides 17 are suitably machine-adjustable as indicated by a motor 18 and a spindle drive 19 driven by the motor and connected to the associated slides 17. The motors 18 are controlled by the controller 11. The detectors 6 are positioned when the printing press is running, suitably during the start-up phase. After they are positioned, the evaluation of the sensor signals is released. This can be done manually from a control console 20 of the printer as indicated by a signal line 21. Automatic release is also possible after positioning. The commands formed by the evaluation of the sensor signal to start the above-cited processes such as "stop printing", etc. are sent by the controller 11 to the printer control as indicated by signal line 22. In the portrayed embodiment, the controller 11 is assigned a memory 23 that records the signals over time so they can be reviewed.

The lateral shift of the web 3 to be expected in normal operation is set as a tolerance range for the controller 11 as indicated in FIG. 5 with the number 24. FIG. 5 shows the characteristic of the intensity I of the signals generated by sensors S1 and S2 over time "t." The signal characteristics of three selected instances are represented in three columns I, II, III. Column I is a normal web run. The signals emitted by the sensors S1, S2 assigned to the two web edges remain in the set tolerance range 24.

The width of the tolerance range 24 can be set in relation to individual factors, e.g., relating to the printer. Different ranges at the two sides of the printer are also conceivable in this context.

When the edges of connected webs 3*a,* 3*b* are offset laterally as indicated in column II in FIG. 5 at the bottom, the signals of the sensors S1, S2 suddenly jump outside of the tolerance range 24 as shown at the top of column II of FIG. 5. This triggers a corresponding command. Column III in FIG. 5 is due to a single-sided defect of the web 3. This can be incomplete adhesion at the joined section of two sequential webs or a small, lateral tear, etc. that arises from transport damage, etc. In this case, only the signal from the sensor S1 detecting the defect goes outside of the tolerance range 24 which also triggers a command.

The fault detector 5 is continuously active from the time of the release until printing is turned off. Accordingly, the sensors forming the monitors 7 receive light continuously, and the nozzles forming the deflection devices 8 are always provided with compressed air. The pressure exerted by the compressed air is of course at a level that does not cause deflection at normal web tension.

I claim:

1. A device to prevent damage to printing groups of web-fed rotary presses which include a reel changer and a cylinder which is placed on the reel changer, the cylinder serving to feed webs to the rotary press, the device comprising:

a fault detector having a deflection device next to each edge of the web for generating a deflective force directed transverse to the plane of the web as it is being transported, said deflection force being overcome by the tension of the web during normal operation, and two monitors each embodied as an optical sensor that emit a signal which depends on interruption by the web;

a monitor that detects changes;

laterally-adjustable slides which are motor driven; and a controller for controlling said laterally-adjustable slides, wherein:

said detection units are on said laterally-adjustable slides, said fault detector being located before the first printing group of the web-fed rotary press, and said detector's optical axis being tilted in the lengthwise direction of the web in relation to the direction of the deflection force that is essentially perpendicular to the transport plane of the web.

2. The device as defined in claim 1, wherein said fault detector is located adjacent to the reel changer.

3. The device as defined in claim 2, wherein said fault detector is located at the outlet of the reel changer.

4. The device as defined in claim 1, wherein said deflection device has at least two deflecting elements on different sides of the web and spaced apart longitudinally along the web.

5. The device as defined in claim 4, wherein said deflecting elements comprise air nozzles which receive compressed air.

6. The device as defined in claim 1, wherein the angle of tilt of said optical axis of said monitor is 60'.

7. The device as defined in claim 1, wherein the signal emitted by said monitor is an analog signal.

8. The device as defined in claim 1, further comprising:

a controller having a computer, and wherein said controller is connected to said monitors in order to process the signals from said monitors.

9. The device as defined in claim 8, wherein said monitors comprise fiberoptic sensors connected via a fiber bundle to said controller.

10. The device as defined in claim 1, wherein said monitors have transmission and receiving elements and these elements are cleaned with air.

11. The device as defined in claim 10, further comprising:

a chamber for receiving compressed air and a slot facing the web, and wherein said transmission and receiving elements of said monitors are situated in said chamber.

12. The device as defined in claim 1, wherein said monitors form a detection unit with said deflection device.

13. The device as defined in claim 1, wherein said controller is programmed to include a settable tolerance relative to a sensor signal, and wherein a control command is generated by at least one sensor signal and this signal is sent to a printer by said controller when the settable tolerance is exceeded, the signal places the printing groups in a "stop printing" position at the time the fault in the web passes through and at least one of a waste paper shunt is activated, a continuous washing system is suppressed and the activation of a web catching device is suppressed.

14. The device as defined in claim 1, wherein said controller includes a memory, and wherein the defects detected by the fault detector are recorded by said memory.

* * * * *